United States Patent [19]

Nicot

[11] 4,135,065

[45] Jan. 16, 1979

[54] CODING SWITCH

[75] Inventor: Jean Nicot, Evreux, France

[73] Assignee: U.S. Philips Corporation, New York, N.Y.

[21] Appl. No.: 746,876

[22] Filed: Dec. 2, 1976

[30] Foreign Application Priority Data

Dec. 22, 1975 [FR] France ..... 75 39296

[51] Int. Cl.[2] ..... H01H 19/54

[52] U.S. Cl. ..... 200/11 DA; 200/11 TW; 200/292

[58] Field of Search ..... 200/11 R, 11 D, 11 DA, 200/11 G, 11 J, 11 K, 11 TW, 252, 292, 155 R, 155, 156

[56] References Cited

U.S. PATENT DOCUMENTS

| | | | |
|---|---|---|---|
| 2,853,564 | 9/1958 | Gahagan | 200/11 TW |
| 2,896,033 | 7/1959 | Hartz | 200/11 DA |
| 3,089,923 | 5/1963 | Wright | 200/11 TW |
| 3,215,790 | 11/1965 | Young | 200/11 D |
| 3,300,748 | 1/1967 | Gabrielian | 200/11 TW X |
| 3,566,049 | 2/1971 | Wright | 200/11 TW |

FOREIGN PATENT DOCUMENTS

| | | | |
|---|---|---|---|
| 2314277 | 10/1974 | Fed. Rep. of Germany | 200/11 DA |

*Primary Examiner*—James R. Scott
*Attorney, Agent, or Firm*—David R. Treacy

[57] ABSTRACT

A coding switch contact arrangement providing binary and complementary binary outputs from a simplified contact layout. Fixed contact tracks are located on one side of a contact board. A switching disc has mutually insulated contact groups whose contact points are radially arranged, at least one group being an angular distance from an adjacent group which is $2^n$ times the distance between switching positions.

3 Claims, 3 Drawing Figures

CODING SWITCH

BACKGROUND OF THE INVENTION

The invention relates to a coding switch, comprising a fixed contact board, one side of which is provided with electrically conductive contact tracks as well as with connection tracks for connecting contact tracks to each other and to terminals, and a switching disc of insulating material which is rotatable about an axis and which is arranged to occupy any of a plurality of switching positions; and more particularly to a switch whose switching disc has at least one contact group which consists of a number of electrically interconnected finger springs, each of which has a contact point on its free end, the contact points bearing on the contact track surfaces, and all contact points of the group forming a straight row along a line which intersects the axis of the switching disc.

A coding switch of this kind is known from German Offenlegungsschrift No. 2,314,277, which shows a switch having one contact group, the row of contact points being sub-divided into two parts which are situated one on each side of the axis of the switching disc. The pattern of the printed circuitry of this switch is comparatively complex; increases the cost of the switch, and also the risk of damaged connection tracks, because a large number of the connection tracks extend between the contact tracks.

SUMMARY OF THE INVENTION

The object of the invention is to provide a coding switch in which the pattern of the printed circuitry is simple. In accordance with the invention a switching disc on a coding switch has a plurality of mutually insulated contact groups, at least two of which are arranged so that the ratio of the angular distance between the two rows of contact points belonging to these two contact groups to the angular distance between two successive switching positions of the switching disc equals $2^n$, n being a positive integer.

Preferably, the ratio of the angular distance between each of the pairs of adjacent rows of contact points to the angular distance between two successive switching positions equals $2^n$, n being a positive integer number whose value may be different for different ones of the distances between rows.

The invention is based on recognition of the fact that the values of successive numbers expressed in a binary code have a useful periodicity because the less significant digits of the binary code are the same for numbers whose arithmetic difference is a power of 2. For example, the number 5 when expressed in the binary or BCD-code (101) differs by only one digit from the binary number 13 (1101) which is eight decimal positions higher.

The use of three contact groups is generally advantageous for complex coding switches such as those which must perform complete coding in the binary system where direct and complementary binary expressions are to be supplied, corresponding to digital information in the normal decimal system or in a duodecimal system. The use of three contact groups permits advantageous sub-division of the contact tracks into a small number of segments of a circle. Furthermore, by optimizing the number and location of contact points in each row, only a minimum number of radial and semi-radial connection tracks will be needed between these segments of a circle.

Embodiments of the invention are described hereinafter in detail by way of example with reference to the accompanying drawings.

DESCRIPTION OF THE PREFERRED EMBODIMENTS

Figure 1:
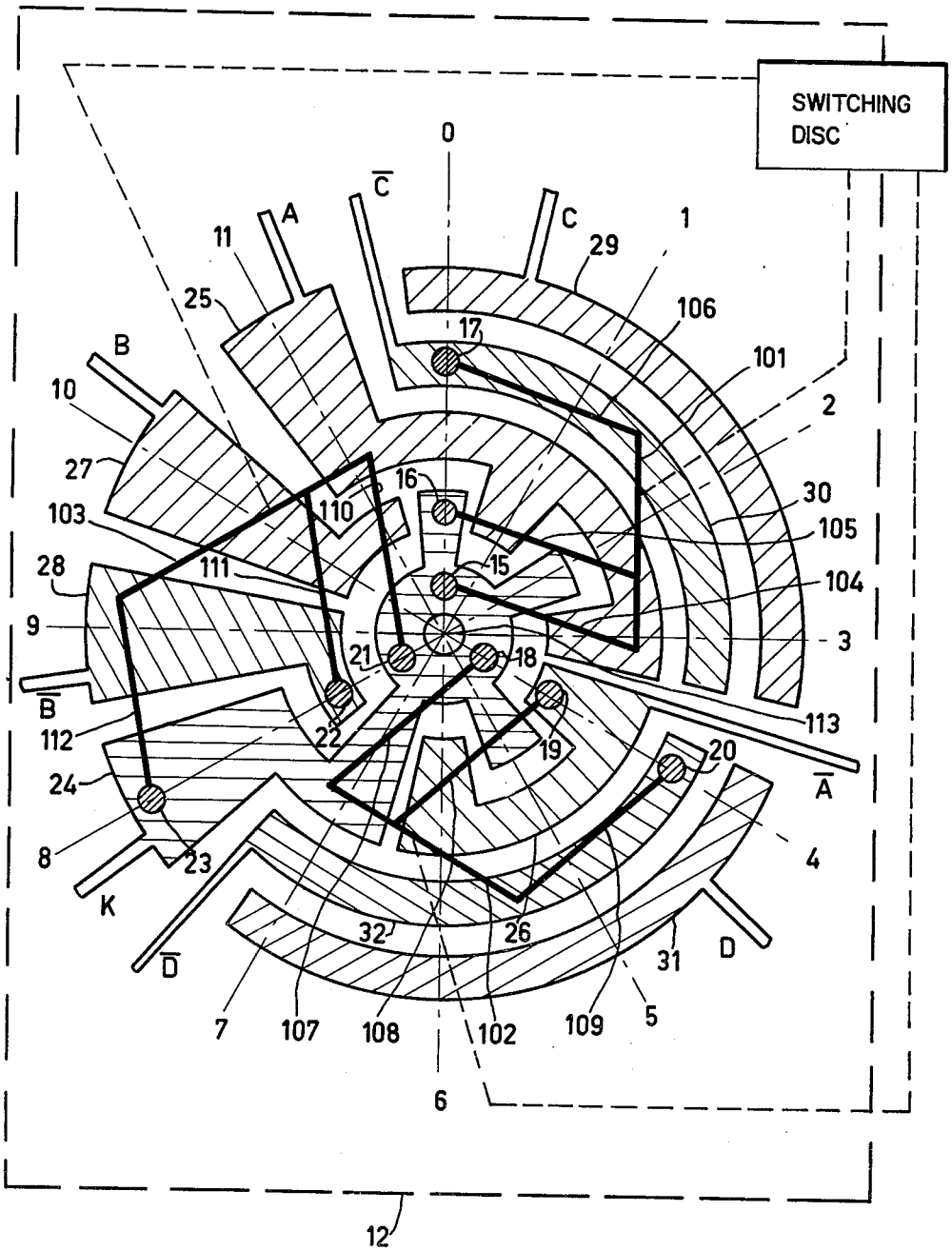
FIG. 1 is a diagrammatic view of a 12-position coding switch in accordance with the invention.

FIG. 1 shows the central portion of a printed circuit board 12, one side of which is provided with electrically conductive fixed contact tracks in the form of concentric circle segments as well as the necessary connection tracks for connecting the contact tracks to each other and to terminals (not shown). Also shown are three contact groups 101, 102, 103, each of which consists of three electrically interconnected finger springs (104, 105, 106) (107, 108, 109) (110, 111, 112) respectively, the ends of which accommodate respective contact points (15, 16, 17) (18, 19, 20) (21, 22, 23) respectively. The contact groups 101, 102, 103 are insulated relative to each other and are mounted on a switching disc (shown schematically) which is rotatable about an axis 113 concentric with the contact tracks and perpendicular to the board 12 and which can occupy any one of twelve switching positions. This may be used, for example, for conversion of duodecimal data to binary coding. In order to keep the figure simple, the known structural details such as the shape and the mounting of the switching disc and the contact groups are not shown. These details can be found, for example, in German Offenlegungsschrift No. 2,314,277 or British Patent specification 954,362, to which U.S. Pat. No. 3,089,923 corresponds.

The three contact points of a contact group form a straight row which is aligned radially with respect to the axis 113 of the switching disc. When the switching disc is in the zero position, for example, the contact points 15, 16, 17 of the contact group 101 are situated along the line denoted by the reference O. The angular distance between two successive switching positions of the switching disc is $360°/12 = 30°$. When the switching disc is successively rotated to the various switching positions, the contact points 15, 16, 17 will be successively situated on the lines denoted by the references 1, 2, 3, . . . 11. The angular distances between each two successive rows of contact points amount to 120° in this example, so that the requirement that the ratio of these angular distances to the angular distance between two successive switching positions must be $2^n$ is satisfied. In this case $n = 2$ for all angular distances between successive rows of contact points.

The contact tracks are formed by conductive circle segments, the angular dimension or circumferential length of which may be as much as 360° in the case of the central contact surface, which is the common point to which the other, individual contact tracks are connected in continuously changing combinations by the various contact groups. The common contact track surface is thus the entire innermost circle. In the embodiment shown, the individual contact surfaces are segments of four outer concentric circles. The contact points 15, 18 and 21 engage the common contact surface situated on the first circle; the contact points 16, 19 and 22 engage the contact surface segments on the second circle; the contact points 17 and 20 engage those on the fourth circle; and the contact point 23 engages the contact tracks on the fifth (outer) circle. The third circle has no contact surfaces, and is used solely for connection tracks which connect the inner contact tracks (first and the second circle) to the terminals shown schematically as track portions extending outward from the fifth circle.

The metal conductors which form the contact tracks and the connection tracks consist of nine individual elements, which is the absolute minimum that will provide a common point and eight connection points for the information required to supply the direct and complementary values in binary code of the first twelve integer numbers: 0, 1, 2, 3, 4, 5, 6, 7, 8, 9, 10 and 11.

In order to facilitate the description of the instantaneous electrical connections for the direct and complementary values expressed in binary code, the symbol A is used hereinafter for the least significant digit, or binary term 1 (first position); the symbol B for the second least significant digit, or binary term 2 (second position); the symbol C for the binary term 4 (third position); and the symbol D for the binary term 8 (fourth position). Similarly, the complementary values of the terms A, B, C and D are represented by the symbols $\overline{A}$, $\overline{B}$, $\overline{C}$ and $\overline{D}$, respectively.

Table 1 shows the individual terminal and conductor surfaces (denoted in FIG. 1 by the symbol of the associated binary term) which must be connected to the common point (denoted by the letter K) for each position of the switching disc, and illustrates the switching operations to be performed for the binary coding of the first twelve integer numbers.

TABLE 1

| Position | Weight | Binary term | Position of the switching disc 0 | 1 | 2 | 3 | 4 | 5 | 6 | 7 | 8 | 9 | 10 | 11 |
|---|---|---|---|---|---|---|---|---|---|---|---|---|---|---|
| 1 | 1 | A | | A | | A | | A | | A | | A | | A |
| | | $\overline{A}$ | $\overline{A}$ | | $\overline{A}$ | | $\overline{A}$ | | $\overline{A}$ | | $\overline{A}$ | | $\overline{A}$ | |
| | | B | | | B | B | | | B | B | | | | B B |
| 2 | 2 | $\overline{B}$ | $\overline{B}$ | $\overline{B}$ | | | $\overline{B}$ | $\overline{B}$ | | | $\overline{B}$ | $\overline{B}$ | | |
| | | C | | | | | C | C | C | C | | | | |
| 3 | 4 | $\overline{C}$ | $\overline{C}$ | $\overline{C}$ | $\overline{C}$ | $\overline{C}$ | | | | | $\overline{C}$ | $\overline{C}$ | $\overline{C}$ | $\overline{C}$ |
| | | D | | | | | | | | | D | D | D | D |
| 4 | 8 | $\overline{D}$ | $\overline{D}$ | $\overline{D}$ | $\overline{D}$ | $\overline{D}$ | $\overline{D}$ | $\overline{D}$ | $\overline{D}$ | $\overline{D}$ | D | D | | |

The common contact of the switch, denoted by the letter K, which may for example be connected to a power supply, is formed by a metal track 24 whose contact surface occupies the entire first one of the five circles.

The fixed contact which corresponds to the binary term A is formed by a metal track 25 whose contact surfaces are situated on the second circle at the first and third positions.

The fixed contact which corresponds to the binary term $\overline{A}$ is formed by a metal track 26 whose contact surfaces are also situated on the second circle, at the fourth and sixth positions.

The fixed contact which corresponds to the binary term B is formed by a metal track 27 whose contact surface extends over two adjacent positions on the second circle only; that is, the tenth and eleventh positions.

The fixed contact which corresponds to the binary term $\overline{B}$ is similarly formed by a metal track 28 whose contact surface extends over the adjacent eighth and ninth positions on the second circle.

The fixed contact which corresponds to the binary term C is formed by a metal track 29 whose contact surface extends along the fifth circle over the zero'th through third positions.

The fixed contact which corresponds to the binary term $\overline{C}$ is formed by a metal track 30 whose contact surface extends along the fourth circle over the zero'th through third positions.

The fixed contact which corresponds to the binary term D is formed by a metal track 31 whose contact surface extends along the fifth circle over the fourth through seventh positions.

The fixed contact which corresponds to the binary term $\overline{D}$ is formed by a metal track 32 whose contact surface extends along the fourth circle over the fourth through seventh positions.

The positions occupied by the various segment-like contact tracks are given in Table 2 in polar co-ordinates on the basis of the order (inner to outer) of the circles and of the angular positions 0 to 11 in FIG. 1

TABLE 2

| Symbol of the contact | Track element | Order of the circle | Angular positions |
|---|---|---|---|
| A | 25 | 2 | 1 3 |
| $\overline{A}$ | 26 | 2 | 4 6 |
| B | 27 | 2 | 10 11 |
| $\overline{B}$ | 28 | 2 | 8 9 |
| C | 29 | 5 | 0 1 2 3 |
| $\overline{C}$ | 30 | 4 | 0 1 2 3 |
| D | 31 | 5 | 4 5 6 7 |
| $\overline{D}$ | 32 | 4 | 4 5 6 7 |

Thus, because of the choice of radial distances at which contact points are located along the three rows, a very simple fixed contact has been provided. The repetition of contacts at every fourth position at a second radial distance (second circle) takes advantage of the repetition pattern of the least and second-least binary digits equivalent to the decimal numbers 0–3, 4–7, and 8–11. Similarly, the use of successive contact points at the third radial distance (fourth circle) enables 4-position fixed contacts $\overline{C}$ and $\overline{D}$ each to provide a signal for eight consecutive switching positions.

Figure 2:
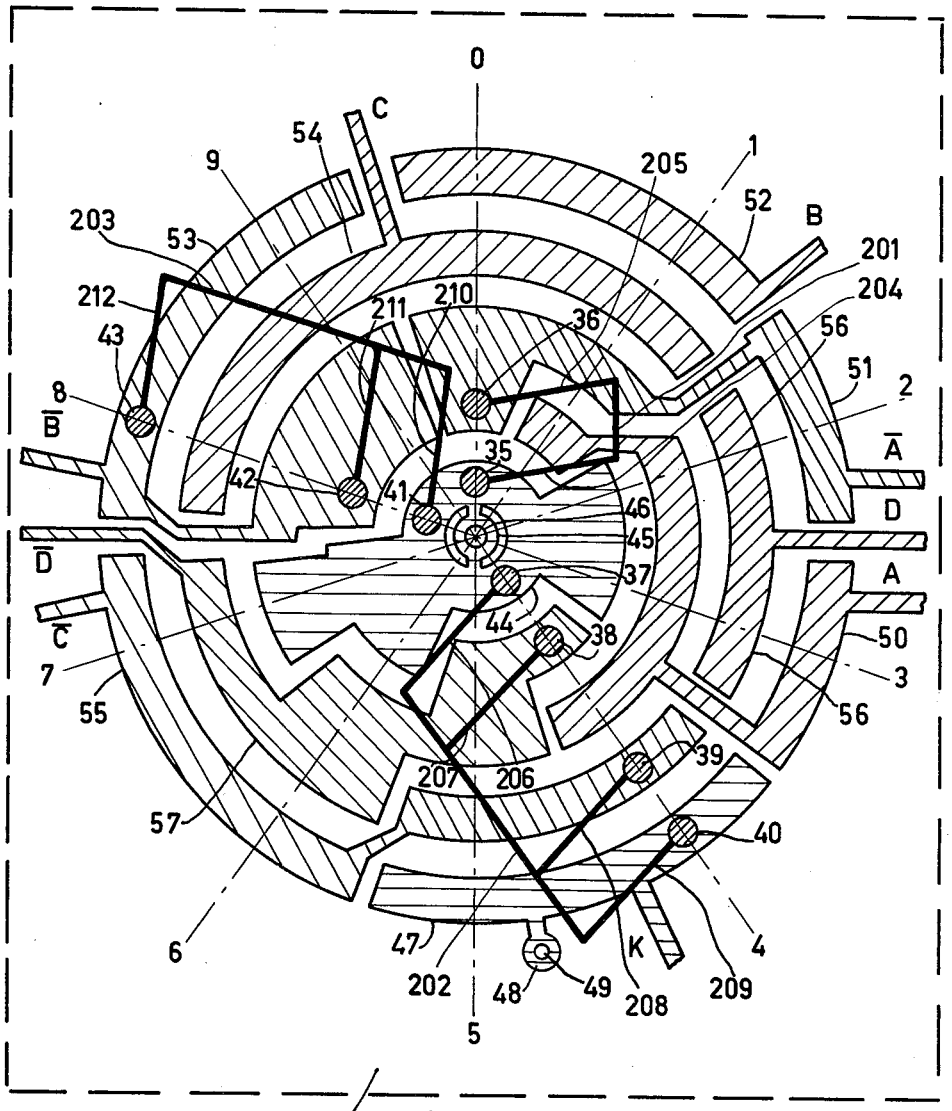
FIG. 2 is a similar view of a 10-position coding switch requiring one jumper wire.

FIG. 2 diagrammatically shows, in approximately the same manner as FIG. 1, the fixed contact tracks and connection tracks and the contact groups connected to the switching disc for a decimal coding switch in accordance with the invention, having ten switching positions which are denoted by the lines 0 to 9 with mutual angular distances of $360°/10 = 36°$.

The conductor tracks of the switch shown in FIG. 2 are provided on one side of a printed circuit board 34. There are three contact groups 201, 202, 203 which are shown in the position occupied when the switching disc indicates the number 0. The first contact group 201 has two finger springs 204, 205, the ends of which accommodate contact points 35 and 36 which are aligned on the radial line denoted by the reference O at radial distances corresponding to the inner, or first, and second circles. The second contact group 202 has four finger springs 207 . . . 209, comprising contact points 37, 38, 39 and 40 which are situated on the line denoted by the reference 4 at radial distances corresponding to the first, second, fourth and fifth circles. The third contact group 203 comprises three finger springs 210, 211, 212, comprising contact points 41, 42 and 43 which are situated on the line denoted by the reference 9 at radial distances corresponding to the first, second and fifth circles. It is clear then that the angular distance between each pair of successive rows of contact points, expressed as a multiple of the angular distance between two successive switching positions, equals a power of 2: the angular distance between the rows of contact points of the contact groups 201 and 202, and 202 and 203, respectively is $4 \times 36°$; that between the rows of the contact groups 203 and 201 is $2 \times 36°$.

The contact points 35, 37 and 41 located at the first circle engage a contact surface which is formed by the central contact 44 which is the common point of the switch.

The number of separate metal conductor elements required equals 10 in this example; because the simplified layout of individual contact and connection tracks does not leave room for a well-separated generally radial connection track to the common-point terminal. Therefore the central contact 44 is connected to the connection track K of the common point by a conductor wire (not shown) routed along the rear of the board 34. Two metal track elements 44 and 47 are required for this purpose. Near its center the central contact 44 has a solder point 45 having a non-plated hole 46, and the fifth or outer conductive circle segment 47 to which the connection track K is connected has a solder point 48 with a central, non-plated hole 49 for access to the connection wire not shown.

The positions occupied by the contact surfaces of the various contact tracks corresponding to respective binary terms is described using polar coordinates based on the order of the circles and of the angular positions 0 to 9 in FIG. 2, in Table 3. As in the switch embodiment of FIG. 1, the third circle is used for connection tracks only, so that individual contact surfaces are needed at only three radial distances.

TABLE 3

| Contact | Track element | Order of the circle | Angular positions | Order of the circle | Angular positions |
|---|---|---|---|---|---|
| $\underline{A}$ | 50 | 2 | 1 | 5 | 3 |
| $\overline{A}$ | 51 | 2 | 0 | 5 | 2 |
| | 52 | | | | |
| $\underline{B}$ | 53 | 5 | 0 1 | | |
| $\overline{B}$ | 54 | 2 | 8 9 | 5 | 8 9 |

TABLE 3-continued

| Contact | Track element | Order of the circle | Angular positions | Order of the circle | Angular positions |
|---|---|---|---|---|---|
| | 55 | | | | |
| $\underline{C}$ | 56 | 4 | 0 1 8 9 | | |
| $\overline{C}$ | 57 | 4 | 4 5 | 5 | 6 7 |
| $\underline{D}$ | | 4 | 2 3 | | |
| $\overline{D}$ | | 2 | 4 5 | 4 | 6 7 |

As in the embodiment of FIG. 1, it will be seen that the contact surfaces for A and A each cover only two switching positions; the surfaces for B and B need only two adjacent positions each; and no contact surface covers more than four adjacent positions. Thus the repetition of contact groups at $2^n$ intervals uses the repetition of the lower order binary digit patterns to allow a simplified track layout, and limit the maximum contact surface length to $2^n$ adjacent positions.

Figure 3:
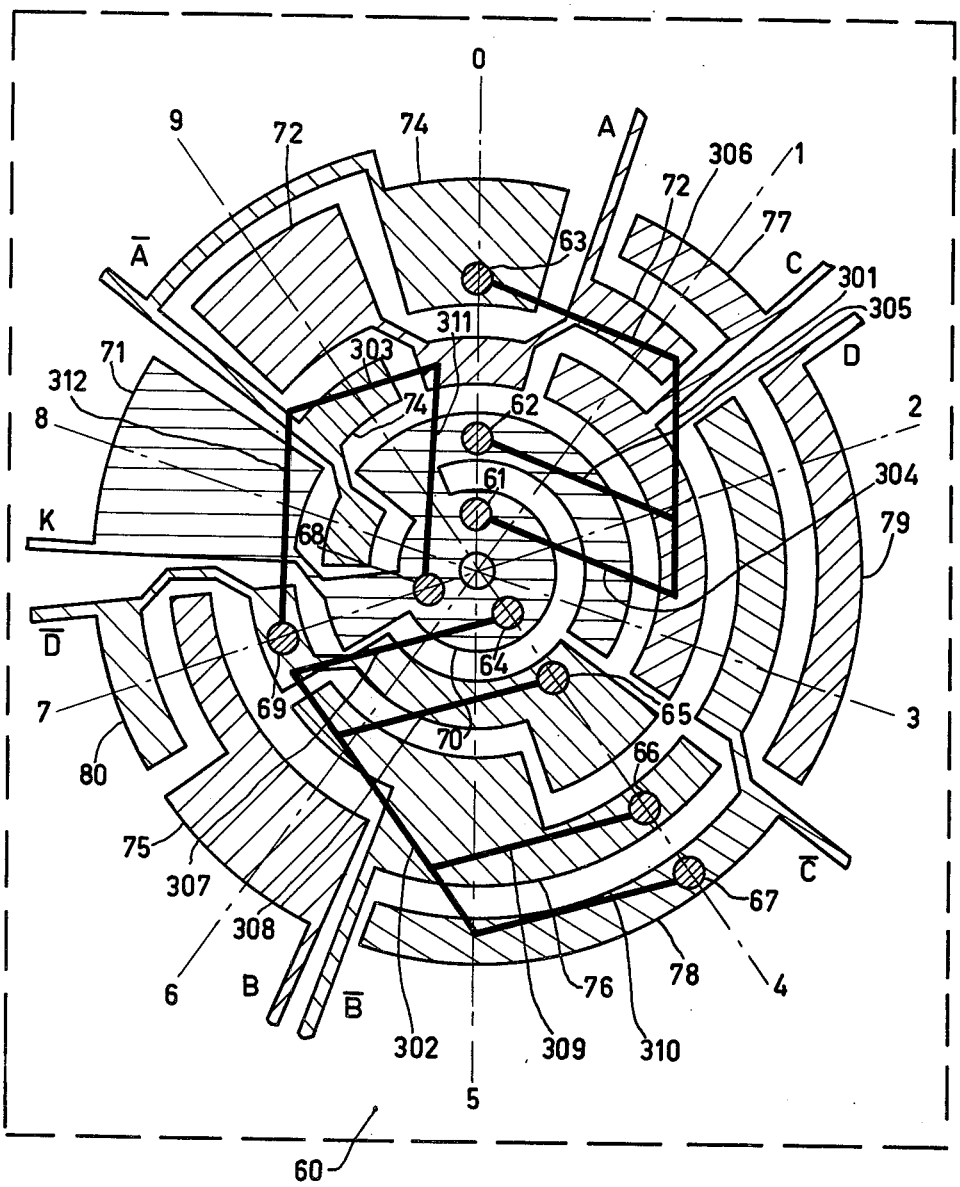
FIG. 3 is a similar view of a different 10-position switch according to the invention.

FIG. 3 diagrammatically shows, in the same manner as the FIGS. 1 and 2, the fixed contact tracks and connection tracks and also the contact groups connected to the switching disc for another decimal encoding embodiment of a switch in accordance with the invention. The ten switching positions which are denoted by the lines 0 to 9 are separated by mutual angular distances of 36°.

The conductor tracks of the switch shown in FIG. 3 are provided on one side of a printed circuit board 60. There are three contact groups 301, 302, 303 which are shown in the position occupied when the switching disc indicates the digit 0. The first contact group 301 has three finger springs 304, 305, 306 with contact points 61, 62 and 63 which are radially aligned along the line denoted by the reference 0, at radial distances corresponding to the first, second and fourth circles on which individual contact track segments are arranged. The second contact group 302 uses four finger springs 307–310 with contact points 64, 65, 66 and 67 which are radially aligned along the line denoted by the reference 4, at radial distances corresponding to the first, second, fourth and fifth circles. The third contact group 303 has two finger springs 311 and 312 with contact points 68 and 69 radially aligned along the line denoted by the reference 7 for engaging surfaces along the first and third circles.

In this embodiment the angular distance between the rows of contact only one pair of adjacent groups, the contact groups 301 and 302, equals a power of two ($4 \times 36°$). The angular distance between the other adjacent row pairs, contact groups 302 and 303, and 303 and 301, respectively, equals $3 \times 36°$, which is not an integral power of 2 times the angular distance between two successive switching positions.

As in the previous described embodiments, the first circle is a contact surface on the central contact 70 which is formed by a conductive element 71 functioning as the contact K, the common point of the switch. The positions occupied by the contact surfaces of the various contact tracks corresponding to respective binary terms is described using polar coordinates based on the order of the circles and of the angular positions 1 to 9 in FIG. 3, in Table 4.

TABLE 4

| Contact | track element | Order of the circle | Angular positions | Order of the circle | Angular positions | Order of the circle | Angular positions | Order of the circle | Angular positions |
|---|---|---|---|---|---|---|---|---|---|
| $\underline{A}$ | 74 | 3 | 0 | 4 | 1 9 | 5 | 9 | | |
| $\overline{A}$ | 75 | 2 | 8 | 3 | 9 | 4 | 0 | 5 | 0 |
| | 76 | | | | | | | | |

TABLE 4-continued

| Contact | track element | Order of the circle | Angular positions | Order of the circle | Angular positions | Order of the circle | Angular positions | Order of the circle | Angular positions |
|---|---|---|---|---|---|---|---|---|---|
| $\underline{B}$ | 77 | 4 | 6 7 | 5 | 6 | | | | |
| $\overline{B}$ | 78 | 3 | 5 6 | 4 | 4 5 | | | | |
| $\underline{C}$ | 79 | 3 | 1 2 3 | 5 | 1 | | | | |
| $\overline{C}$ | 80 | 4 | 2 3 | 5 | 4 5 | | | | |
| $\underline{D}$ | | 5 | 2 3 | | | | | | |
| $\overline{D}$ | | 2 | 4 5 6 | 3 | 4 7 | 5 | 7 | | |

As in the embodiments previously described, no fixed track covers more than $2^n$, where n=2, consecutive positions; and at least one of the second least significant digits needs a track covering only two adjacent positions. However, to provide a pathway for a well-isolated connection track to the inner, common-contact circle, by comparison with FIGS. 1 and 2 a more complex individual contact surface arrangement is utilized. Nevertheless, only four circles are needed for the individual track segments.

It will be clear to those skilled in the art that the choice of n for the $2^n$ relationship will take into account the number of switching positions, and values of n greater than 2 will allow use of only a few contact groups on the disc when binary numbers having more than four digits are to be encoded.

What is claimed is:

1. A coding switch for providing binary and complementary binary outputs corresponding to a selected one of a plurality of rotary switching positions, comprising:

a contact board having a common contact track and a plurality of individual contact tracks corresponding to respective individual binary digits and their complements on one side only, located about an axis perpendicular to the board, said individual contact tracks having contact surfaces concentric with said axis at a plurality of distances from the axis, said plurality of individual tracks being at the most equal to the number of digits in the largest binary number to be coded; and a switching disc mounted for rotation about said axis of rotation between successive switching positions, said switching positions being separated by a given angular distance; and said disc having a plurality of contact groups, each group having a row of contact points aligned radially from said axis for making electrical contact with respective contact surfaces, at least one of said contact rows engaging contact track surfaces at a first plurality of radial distances from said axis and a second of said contact rows engaging contact track surfaces at a different plurality of radial distances from the axis; at least two adjacent rows being separated by an angular distance equal to two or four times said given angular distance.

2. A twelve position coding switch as claimed in claim 1, wherein the common track contact surface is an innermost track, and the contact tracks for the second least significant binary digit and its complement respectively have an angular length extending over two adjacent switching positions only, and the switching disc has three contact groups, the respective rows of contact points being equi-angularly spaced from each other.

3. A ten-position coding switch as claimed in claim 2, wherein the common track contact surface is an innermost track, the individual contact tracks have contact surfaces having a circumferential length extending over a maximum of four adjacent switching positions, the contact track for a second least significant binary digit has an angular length extending over two adjacent switching positions only, and the switching disc has three contact groups, the third one of said rows of contact points engaging contact track surfaces at a different plurality of radial distances from the axis than each of the other rows.

* * * * *